US010886604B2

(12) United States Patent
Quarfoth

(10) Patent No.: US 10,886,604 B2
(45) Date of Patent: Jan. 5, 2021

(54) INTERLEAVED ARRAY OF ANTENNAS OPERABLE AT MULTIPLE FREQUENCIES

(71) Applicant: HRL Laboratories, LLC, Malibu, CA (US)

(72) Inventor: Ryan G. Quarfoth, Los Angeles, CA (US)

(73) Assignee: HRL Laboratories, LLC, Malibu, CA (US)

( * ) Notice: Subject to any disclaimer, the term of this patent is extended or adjusted under 35 U.S.C. 154(b) by 135 days.

(21) Appl. No.: 16/225,960

(22) Filed: Dec. 19, 2018

(65) Prior Publication Data

US 2019/0245263 A1 Aug. 8, 2019

Related U.S. Application Data

(60) Provisional application No. 62/627,140, filed on Feb. 6, 2018.

(51) Int. Cl.

| | |
|---|---|
| ***H01Q 1/28*** | (2006.01) |
| ***H01Q 5/30*** | (2015.01) |
| ***H01Q 21/00*** | (2006.01) |

(52) U.S. Cl.

CPC ..... *H01Q 1/28* (2013.01); *H01Q 5/30* (2015.01); *H01Q 21/0025* (2013.01); *H01Q 21/0068* (2013.01)

(58) Field of Classification Search

CPC ..... H01Q 1/28; H01Q 1/288; H01Q 3/21; H01Q 3/2117; H01Q 3/2623; H01Q 3/30; H01Q 3/34; H01Q 3/36; H01Q 3/443; H01Q 5/30; H01Q 5/307; H01Q 5/35; H01Q 5/50; H01Q 11/02; H01Q 11/04; H01Q 11/14; H01Q 11/18; H01Q 13/20; H01Q 13/24; H01Q 13/26; H01Q 21/0006; H01Q 21/0025; H01Q 21/0037; H01Q 21/0043; H01Q 21/005; H01Q 21/065; H01Q 21/0068; H01Q 21/08; H01Q 21/12; H01Q 21/22; H01Q 21/28

See application file for complete search history.

(56) References Cited

U.S. PATENT DOCUMENTS

| | | | | |
|---|---|---|---|---|
| 5,557,291 | A | 9/1996 | Chu et al. | |
| 6,509,881 | B2 * | 1/2003 | Falk | H01Q 13/10 343/770 |

(Continued)

OTHER PUBLICATIONS

Ruey-Shi Chu et al., "Multiband Phased-Array Antenna with Interleaved Tapered-Elements and Waveguide Radiators," IEEE Antennas and Propagation Society International Symposium. 1996 Digest, Baltimore, MD, USA, 1996, pp. 1616-1619 vol. 3.

(Continued)

*Primary Examiner* — Daniel Munoz
*Assistant Examiner* — Patrick R Holecek
(74) *Attorney, Agent, or Firm* — Ladas & Parry

(57) ABSTRACT

An interleaved array of electronically steerable antennas is capable of simultaneously operating and/or independently beam scanning at different frequencies from a single aperture. An antenna system may comprise a plurality of electronically steerable antennas configured to be operable at different frequencies, each of the antennas comprising a feed launching a surface wave and surface-wave waveguides connected to the feed. The surface-wave waveguides of the antennas operable at different frequencies may be interleaved with each other.

21 Claims, 13 Drawing Sheets

(56) References Cited

U.S. PATENT DOCUMENTS

| | | | | |
|---|---|---|---|---|
| 9,112,270 | B2 * | 8/2015 | Warnick | H01Q 5/35 |
| 9,455,495 | B2 * | 9/2016 | Gregoire | H01Q 3/443 |
| 9,837,695 | B2 * | 12/2017 | Gregoire | H10Q 15/0066 |
| 2002/0003502 | A1 | 1/2002 | Falk | |
| 2014/0111396 | A1 * | 4/2014 | Hyjazie | H01Q 1/52 343/798 |
| 2015/0009071 | A1 | 1/2015 | Gregoire | |
| 2015/0222022 | A1 | 8/2015 | Kundtz et al. | |
| 2017/0352958 | A1 | 12/2017 | Lee et al. | |

OTHER PUBLICATIONS

D. H. Roper, W. E. Babiec and D. D. Hannan, "WGS Phased Arrays Support Next Generation DoD Satcom Capability," IEEE International Symposium on Phased Array Systems and Technology, 2003, pp. 82-87.

D.F. Gregoire et al., "A Low Profile Electronically-Steerable Artificial-Impedance-Surface Antenna," 2014 International Conference on Electromagnetics in Advanced Applications (ICEAA), Palm Beach, 2014, pp. 477-479.

International Search Report for PCT/US2018/066587 dated Apr. 16, 2019.

Written Opinion of the International Searching Authority for PCT/US2018/066587 dated Apr. 16, 2019.

International Preliminary Report on Patentability (Chapter I) for PCT/US2018/066587 dated Aug. 20, 2020.

* cited by examiner

INTERLEAVED ARRAY OF ANTENNAS OPERABLE AT MULTIPLE FREQUENCIES

CROSS REFERENCE TO PARENT APPLICATION

This application claims the benefit of U.S. Application No. 62/627,140, filed on Feb. 6, 2018, the disclosure of which is hereby incorporated by reference in its entirety.

TECHNICAL FIELD

The present disclosure generally relates to antennas and, in particular, to electronically steerable antennas. Still more particularly, certain embodiments of the present disclosure may relate to interleaved arrays of electronically steerable antennas capable of simultaneously operating and/or independently beam scanning at different frequencies from a single aperture.

BACKGROUND

In applications where multiple antennas are needed but space is very limited, providing multiple antennas to handle multiple tasks becomes difficult. For example, two major satellite frequency bands are used for mobile internet, e.g. connectivity to commercial airplanes. These networks operate in the Ku and Ka bands, but each aircraft has to choose only one frequency band. This selection may limit throughput and may also limit the locations globally where the aircraft can operate. Using multiple apertures for a plurality of antennas may be considered. However, the available antenna installation space can be limited. Therefore, an antenna system having a plurality of antennas operating at different frequencies while sharing a common antenna aperture may be desirable.

A number of wideband array designs have been proposed:

1. Ruey-Shi Chu et al., "Multiband phased-array antenna with interleaved tapered-elements and waveguide radiators," IEEE Antennas and Propagation Society International Symposium, 1996 Digest, Baltimore, Md., USA, 1996, pp. 1616-1619 vol. 3.
2. U.S. Pat. No. 5,557,291, entitled "Multiband, phased-array antenna with interleaved tapered-element and waveguide radiators"
3. D. H. Roper, W. E. Babiec and D. D. Hannan, "WGS phased arrays support next generation DoD SATCOM capability," IEEE International Symposium on Phased Array Systems and Technology, 2003, pp. 82-87.

It would be desirable to have an apparatus and method that take into account some of the issues discussed above, as well as other possible issues.

SUMMARY

The features and advantages of the present disclosure will be more readily understood and apparent from the following detailed description, which should be read in conjunction with the accompanying drawings, and from the claims which are appended to the end of the detailed description.

According to some embodiments of the present disclosure, an antenna system may comprise a plurality of electronically steerable antennas configured to be operable at different frequencies, each of the antennas comprising: a feed arranged for launching a surface wave, and surface-wave waveguides connected to the feed. The surface-wave waveguides of the antennas operable at different frequencies may be interleaved with each other.

In certain embodiments of the present disclosure, the plurality of electronically steerable antennas may comprise: a first antenna configured to operate at a first frequency, the first antenna comprising first waveguides; and a second antenna configured to operate at a second frequency different from the first frequency, the second antenna comprising second waveguides, wherein the first waveguides of the first antenna and the second waveguides of the second antenna may be interleaved with each other. The first waveguides of the first antenna and the second waveguides of the second antenna may be disposed to alternate with each other.

In various embodiments of the present disclosure, the first antenna and the second antenna may be configured to be simultaneously operable at the first frequency and the second frequency, respectively. The first and second antennas may be installed in a single aperture.

According to certain embodiments of the present disclosure, the first waveguides may comprise first impedance elements and first tuning elements, at least one of the first tuning elements connected between the first impedance elements. The second waveguides may comprise second impedance elements and second tuning elements, at least one of the second tuning elements connected between the second impedance elements.

In some embodiments of the present disclosure, the antenna system may further comprise first control lines coupled to the first waveguides to supply a first voltage or current to the first tuning elements, and second control lines coupled to the second waveguides to supply a second voltage or current to the second tuning elements.

In certain embodiments of the present disclosure, the first waveguides and the second waveguides are parallel to each other, and the first waveguides and the second waveguides are perpendicular to the first control lines and the second control lines. The first control lines for the first antenna and the second control lines for the second antenna may be arranged not to contact each other.

According to various exemplary embodiments of the present disclosure, the first control lines for the first antenna may be disposed not to contact the second waveguides for the second antenna and the second control lines for the second antenna may be disposed not to contact the first waveguides for the first antenna.

In some embodiments of the present disclosure, the first control lines for the first antenna may pass underneath the second waveguides for the second antenna and the second control lines for the second antenna may pass underneath the first waveguides for the first antenna.

In certain embodiments of the present disclosure, the antenna system may further comprise a dielectric layer having a first surface and a second surface. The first and second waveguides may be disposed on the first surface of the dielectric layer. Some portions of the first and second control lines may be disposed on the first surface of the dielectric layer, and other portions of the first and second control lines may be disposed on the second surface of the dielectric layer so that the first control lines do not contact the second waveguides and the second control lines do not contact the first waveguides.

In various embodiments of the present disclosure, the antenna system may further comprise vias formed in the dielectric layer, the vias connecting between the some portions of the first and second control lines disposed on the first surface and the other portions of the first and second control lines disposed on the second surface.

According to various embodiments of the present disclosure, the antenna system may further comprise a conductive fence, also known as a "via fence" or "picket fence," between one of the first waveguides and one of the second waveguides. The conductive fence may comprise a metal grid. The conductive fence may comprise vias formed in a vertical direction and horizontal conductive lines formed on at least one metal layer.

In some embodiments of the present disclosure, the antenna system may further comprise via pads formed on the vias, the via pads having a larger diameter than the vias.

According to certain embodiments of the present disclosure, the antenna system may further comprise a capacitor positioned between the conductive fence and one of the first or second control lines. In one exemplary embodiment, the capacitor may be disposed on the first surface of the dielectric layer. In another exemplary embodiment, the capacitor may be formed on the first surface of the dielectric layer between the conductive fence and one of the vias.

According to various embodiments of the present disclosure, the antenna system may comprise: a first ground layer for the first waveguides; and a second ground layer for the second waveguides.

In some embodiments of the present disclosure, the first and second tuning elements may comprise at least one of a capacitor, a varactor or a diode.

In certain embodiments of the present disclosure, the first and second impedance elements may comprise a conductive patch, where the patch may have a polygonal, planar, filled shape that is often rectangular.

A better understanding of the nature and advantages of the present disclosure may be gained with reference to the detailed description and the drawings below.

BRIEF DESCRIPTION OF THE DRAWINGS

Various embodiments in accordance with the present disclosure will be described with reference to the drawings, in which.

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION OF EMBODIMENTS

In the following detailed description, reference is made to the accompanying drawings which form a part hereof, and in which are shown by way of illustration specific embodiments in which the invention may be practiced. These embodiments are described in sufficient detail to enable those skilled in the art to practice the invention, and it is to be understood that other embodiments may be utilized and that structural, logical and electrical changes may be made without departing from the spirit and scope of the invention. The following detailed description is therefore not to be taken in a limiting sense, and the scope of the invention is defined only by the appended claims and equivalents thereof. Like numbers in the figures refer to like components, which should be apparent from the context of use.

Figure 1:
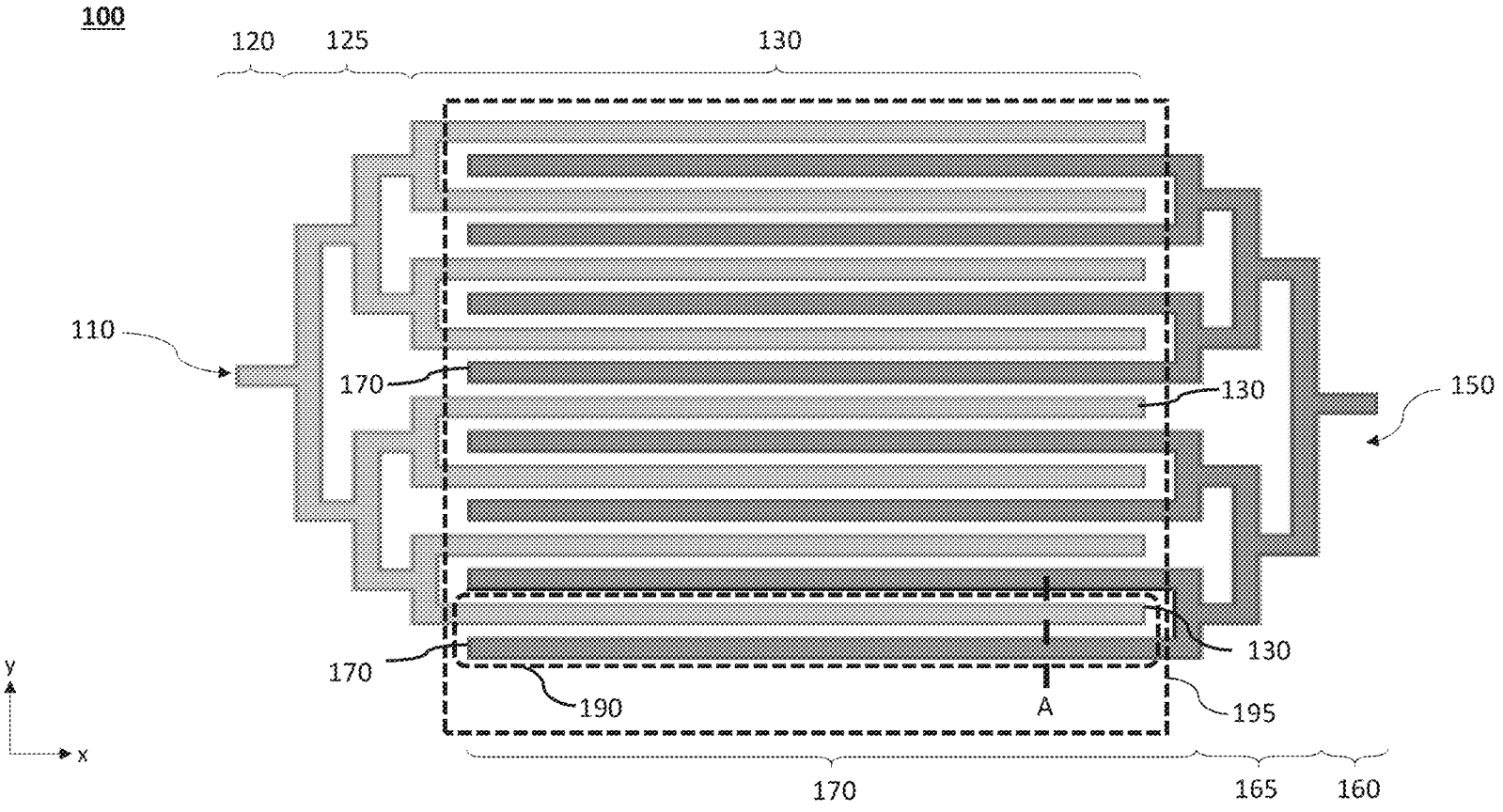
FIG. 1 is a simplified conceptual diagram of arrays of antennas according to an exemplary embodiment of the present disclosure.

Referring now to the figures and, in particular, with reference to FIG. 1, an illustration of arrays of antennas in the form of a simplified conceptual diagram is depicted in accordance with an exemplary embodiment.

An antenna system may comprise the arrays 100 of antennas including first and second antennas 110 and 150. The arrays 100 of antennas may comprise electronically steerable antennas. An electronically-steerable antenna may be capable of being electronically steered in one or more directions using electronic, rather than mechanical, means. For example, the antenna may be steered by directing the primary gain lobe, or main lobe, of the radiation pattern of the antenna in a particular direction. Artificial-impedance-surface antennas (AISAs) (also known as holographic antennas or modulated impedance leaky-wave antennas) is one example of electronically steerable antennas.

The antennas 110 and 150 may be, for example, but not limited to, such AISAs. The AISAs may radiate by spatially modulating the velocity of surface waves propagating along an artificial-impedance surface. The surface-wave modulation can be accomplished with a distribution of reactive elements on a dielectric substrate. When the reactive elements have fixed properties, the AISA has a fixed radiation pattern. When the reactive elements are tunable, the AISA radiation pattern is steerable. The AISAs stay be realized by launching a surface wave across an artificial impedance surface, whose impedance is spatially modulated across the artificial impedance surface according to a function that matches the phase fronts between the surface wave on the artificial impedance surface and the desired far-field radiation pattern. Each of antennas 100 may comprise the same or similar elements, such as disclosed in D. F. Gregoire et al., "A Low Profile Electronically-Steerable Artificial-Impedance-Surface Antenna," 2014 International Conference on Electromagnetics in Advanced Applications (ICEAA), Palm Beach, 2014, pp. 477-479 which is incorporated herewith in its entirety. Although FIGS. 2 and 3 illustrate that the antennas 100 are implemented as AISAs, the antennas 110 and 150 can be any electrically steerable antenna if appropriate.

The arrays 100 of antennas may be receivers, transmitters, or a combination of the two. For example, all antennas may be receivers, all antennas may be transmitters, or one or some of the antennas included in the arrays 100 of antennas may be receiver(s) and the other antennas may be transmitter(s). Alternatively, each of the antennas 110 and 150 may be fed with Transmit/Receive (T/R) modules, for example, a transmit/receive module 610 shown in FIG. 6. The antennas 110 and 150 may be configured to transmit and/or receive a radiation pattern. The radiation pattern may be a plot of the gain of the antennas 110 and 150 as a function of direction. The gain of the antennas 110 and 150 may be considered a performance parameter for the antennas 110 and 150. In some cases, "gain" is considered the peak value of gain. The antennas 110 and 150 may be configured to electronically control the radiation pattern. When the antenna 110 or 150 is used for transmitting, the radiation pattern may be the strength of the radio waves transmitted from the antenna 110 or 150 as a function of direction. The radiation pattern may be referred to as a transmitting pattern when the antenna 110 or 150 is used for transmitting. The gain of the antenna 110 or 150, when transmitting, may describe how well the antenna 110 or 150 converts electrical power into electromagnetic radiation, such as radio waves, and transmits the electromagnetic radiation in a specified direction. When the antenna 110 or 150 is used for receiving, the radiation pattern may be the sensitivity of the antenna 110 or 150 to radio waves as a function of direction. The radiation pattern may be referred to as a receiving pattern when the antenna 110 or 150 is used for receiving. The gain of the antenna 110 or 150, when used for receiving, may describe how well the antenna 110 or 150 converts electromagnetic radiation, such as radio waves, arriving from a specified direction into electrical power. The transmitting pattern and receiving pattern of the antennas 110 or 150 may be identical. According to embodiments of the present disclosure, the transmitting pattern and receiving pattern of the antennas 100 may be simply referred to as a radiation pattern.

The array 100 of antennas comprises the plurality of antennas. In one exemplary embodiment, the array 100 of antennas may comprise two antennas, a first antenna 110 and a second antenna 150. Although two antennas are shown in FIG. 1, this is for illustration purposes only and is not intended to be restrictive of the invention. A greater number of antennas may be used if desired.

The first antenna 110 may be configured to be operable at a first frequency $f_1$, and the second antenna 150 may be configured to be operable at a second frequency $f_2$. The first operation frequency $f_1$ of the first antenna 110 may be different from the second operation frequency $f_2$ of the second antenna 150. For example, the first frequency $f_1$ may be 8 GHz and the second frequency $f_2$ may be 12 GHz. In the embodiments of the present disclosure, the plurality of antennas can be operated at different frequencies simultaneously and/or perform independent beam scanning at different frequencies. For example, the first antenna 110 and the second antenna 150 may have the ability to simultaneously scan beams at different frequencies, such as the first frequency $f_1$ and the second frequency $f_2$, respectively.

When the first frequency $f_1$ of the first antenna 110 is identical to the second frequency $f_2$ of the second antenna 150, coupling between the first antenna 110 and the second antenna 150 may be strong so that the radiation can be caused in undesired directions.

The array spacing of each antenna 110 and 150, may be small enough to allow beam scanning at each frequency.

The first antenna 110 may comprise a first surface-wave feed 120, a first feed network 125, and a plurality of first surface-wave waveguides 130. The second antenna 150 may comprise a second surface-wave feed 160, a second feed network 165, and a plurality of second surface-wave waveguides 170. In one illustrative example, one end of the surface-wave feeds 120 and 160 may be connected to any device that is capable of converting a surface wave into a radio frequency signal and/or a radio frequency signal into a surface wave. The other end of the surface wave feeds 120 and 160 may be coupled to the ends of the surface-waveguides 130 and 170 on a dielectric substrate. The surface-wave feed 120 or 160 launches a surface wave into the surface-wave waveguide 130 or 170 through the feed network 125 or 165. The feed network 125 or 165 distributes the surface wave to the surface-wave waveguides 130 or 170. The surface-wave waveguides 130 or 170 constrain the path of the surface wave propagated along the surface-wave waveguides 130 or 170. The surface-wave waveguides 130 or 170 may lie parallel to each other with their axes parallel to the x direction and may be spaced apart from each other in the y direction.

In an exemplary embodiment, surface-waveguides of each antenna may have the same or substantially similar widths. For example, the width (y-axis) of the first surface-wave waveguides 130 of the first antenna 110 may be substantially identical or similar to the width (y-axis) of the second surface-wave waveguides 170 of the second antenna 150. In an alternative exemplary embodiment, a higher frequency antenna may have a surface-wave waveguide with a narrower width (y-axis). For instance, when the first operation frequency $f_1$ of the first antenna 110 is 8 GHz and the second operation frequency $f_2$ of the second antenna 150 is 12 GHz, the width (y-axis) of the first surface-wave waveguides 130 may be 10 mm and the width (y-axis) of the second surface-wave waveguides 170 may be 7 mm.

The first surface-wave waveguides 130 of the first antenna 110 and the second surface-wave waveguides 170 of the second antenna 150 may be arranged in an interleaved relationship. For instance, the first surface-wave waveguides 130 may be interleaved with the second surface-wave waveguides 170, and/or the second surface-wave waveguides 170 may be interleaved with the first surface-wave waveguides 130. In one exemplary embodiment shown in FIG. 1, the first surface-wave waveguides 130 and the second surface-wave waveguides 150 may be disposed to alternate with each other. Alternatively, two or more first surface-wave waveguides 130 may be interleaved between the second surface-wave waveguides 170, and/or two or more second surface-wave waveguides 170 may be interleaved between the first surface-wave waveguides 130.

The first surface-wave waveguides 130 of the first antenna 110 and the second surface-wave waveguides 170 of the second antenna 150 may be parallel to and/or spaced apart from each other. The first surface-wave waveguides 130 may be arranged not to contact the second surface-wave waveguides 170. Likewise, the second surface-wave waveguides 170 may be arranged not to contact the first surface-wave waveguides 130.

Because of an interleaved arrangement of the arrays of antennas 100, the first antenna 110 and the second antenna 150 may be located in the same physical space. In the present embodiment, both the first antenna 110 and the second antenna 150 which may operate at different frequencies may be disposed in a single antenna aperture 195. In some embodiment of the present disclosure, a single aperture may operate over multiple frequencies allowing wide coverage. Additionally, certain embodiments of the present disclosure may provide multi-functional capability from the same physical space and allow size reduction of the antenna array package.

The array of antennas 100 may be implemented using a dielectric substrate. The dielectric substrate may be implemented as a layer of dielectric material. A dielectric material may be an electrical insulator that can be polarized by an applied electric field. For example, the dielectric substrate may be made from Printed Circuit Board (PCB) material which has a metallic conductor disposed preferably on both of its major surfaces, the metallic conductor on the top or upper surface being patterned using conventional PCB fabrication techniques to define the aforementioned array of antennas 100 from the metallic conductor originally formed on the upper surface of the PCB. The surface-wave feeds 120 and 160, the feed networks 125 and 165 and the surface-wave waveguides 130 and 170 may be etched or fabricated on the top and/or bottom surface(s) of the dielectric substrate, for example, a first dielectric layer 410 shown in FIG. 4.

In various exemplary embodiments, the array of antennas 100 may be implemented using a PCB having multiple layers as shown in FIGS. 2A, 2C, 3A, 3C, 3D and 4. In other words, the arrays of antennas 100 may be designed to be compatible with a printed circuit stackup consisting of sandwiched layers of dielectric and metal along with vertical conductive vias.

By using a printed circuit board design, some embodiments of the present disclosure may allow cheaper fabrication and thinner antenna design (for example, as small as $\lambda/20$ or below, where $\lambda$ is a wavelength of a radiating element or antenna) than wideband array designs which may require an electrically thick antenna design on the order of $\lambda/4$ or more.

A more detailed description of exemplary embodiments of the multilayer structure, elements and function of the first antenna 110 and the second antenna 150 will be described below. For illustration purposes, FIGS. 2A-3D show an interleave antenna element 190 consisting of one first surface-wave waveguide 130 of the first antenna 110 and one second surface-wave waveguide 170 of the second antenna 150.

Figure 2A:
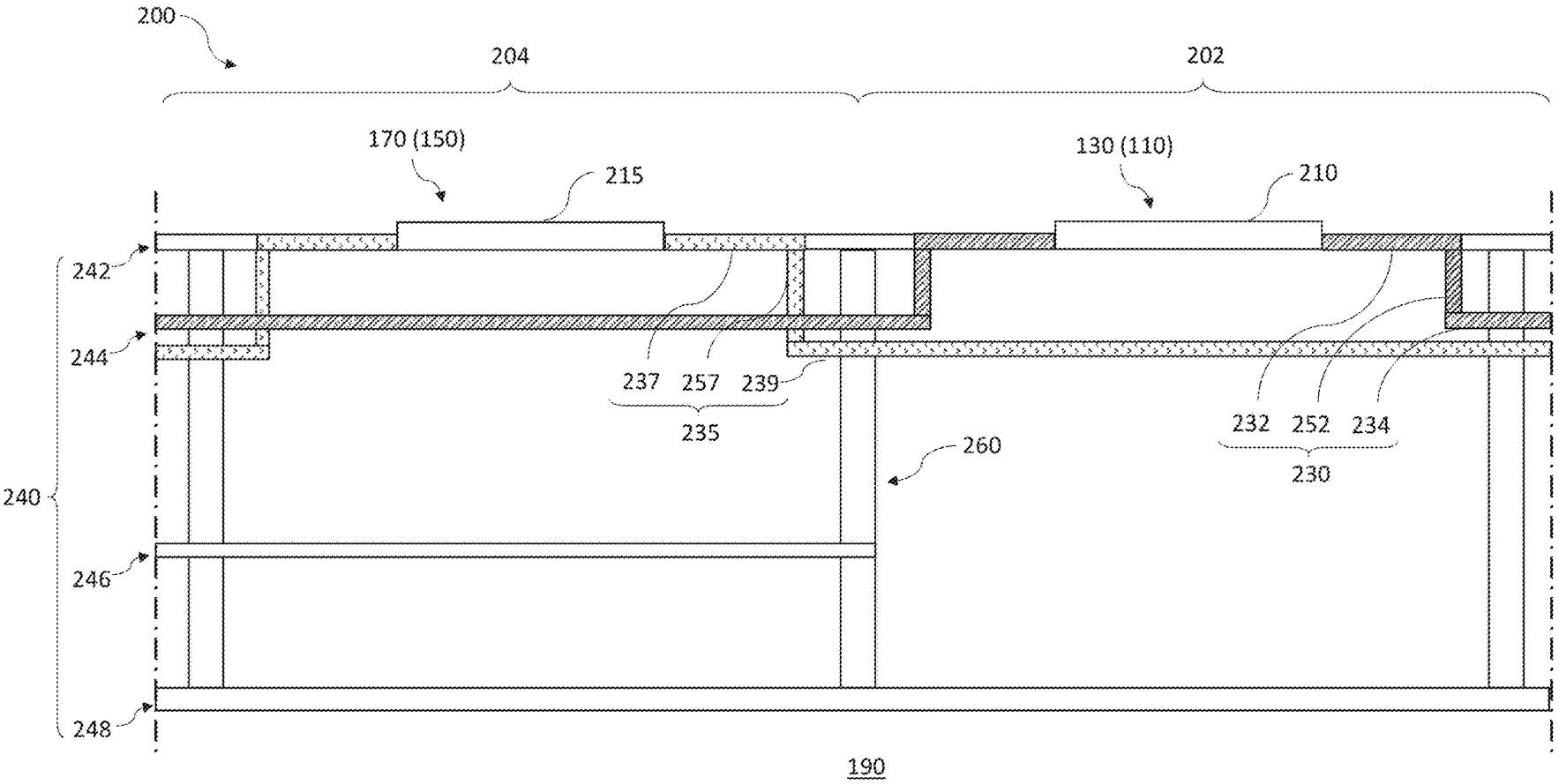
FIG. 2A is a cross-sectional view of an interleaved antenna element of an antenna system according to a first embodiment of the present disclosure.
Figure 2B:
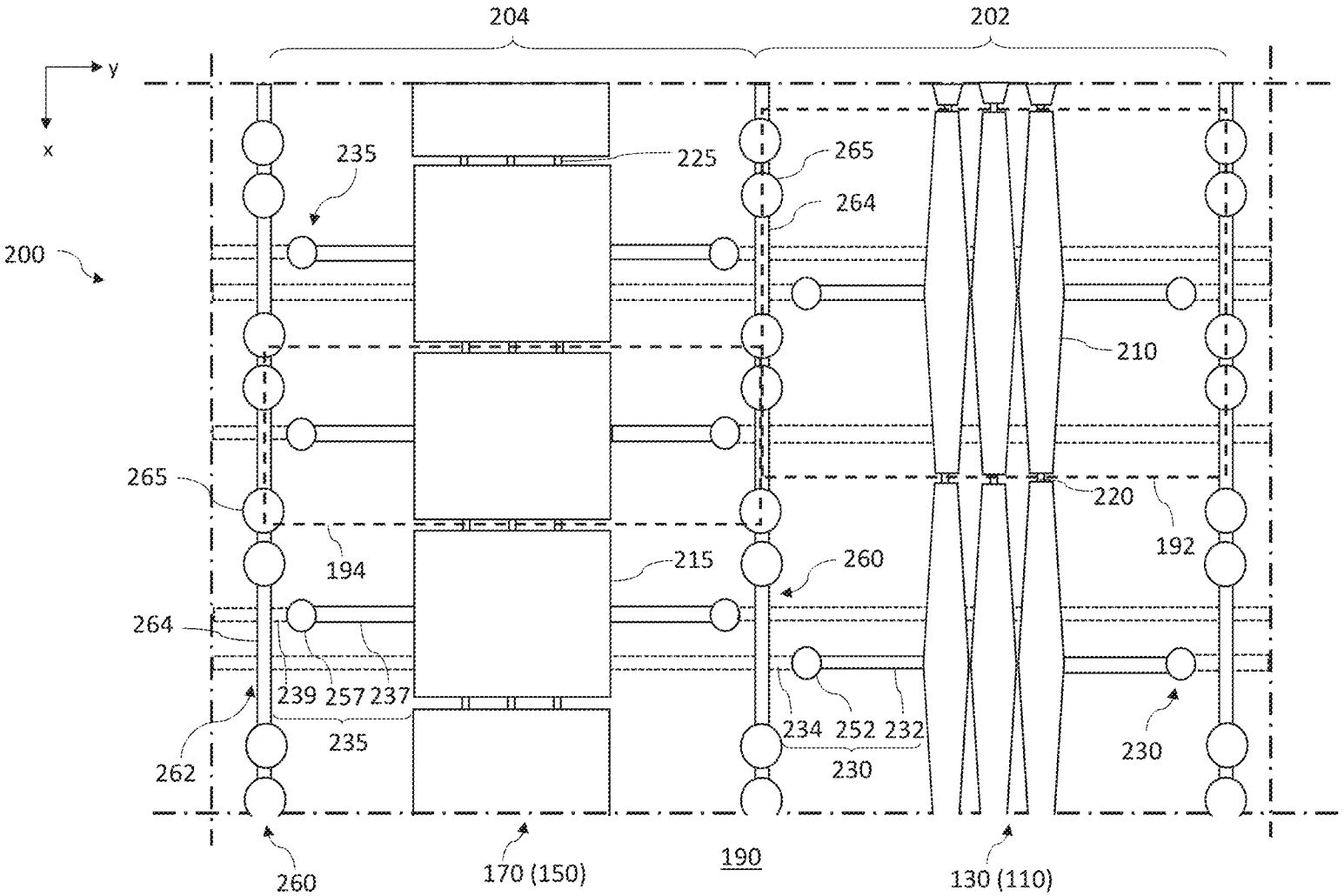
FIG. 2B is a top view of an interleaved antenna element of an antenna system according to a first embodiment of the present disclosure.
Figure 2C:
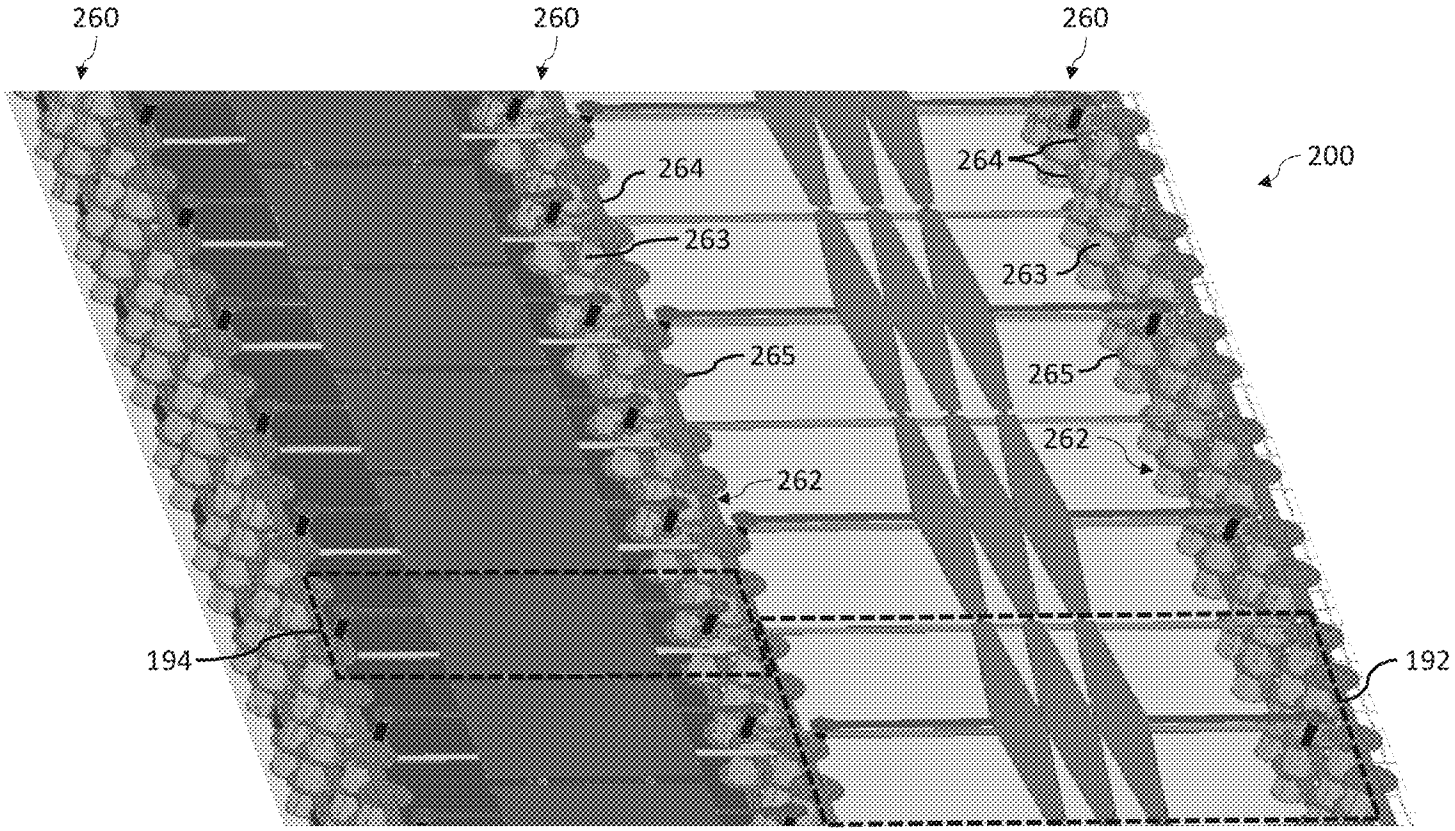
FIG. 2C is an angular perspective view of an interleaved antenna element of an antenna system according to a first embodiment of the present disclosure.

FIG. 2A is a cross-sectional view of an interleaved antenna element along a line A of FIG. 1 according to an embodiment of the present disclosure. FIG. 2B is a top view of an interleaved antenna element according to an embodiment of the present disclosure. FIG. 2C is an angular perspective view of an interleaved antenna element according to an embodiment of the present disclosure.

The interleaved array element 190 includes one first surface-wave waveguide 130 of the first antenna 110 and one second surface-wave waveguide 170 of the second antenna 150. In FIGS. 2A-2C, the right half section 202 of the interleaved antenna element 190 is a section for the first antenna 110, and the left half section 204 of the interleaved antenna element 190 is a section for the second antenna 150. Each antenna element, 130 and 170, are comprised of unit cells, 192 and 194, which are repeated periodically in the x-direction to form the antenna elements. In order to perform beam scanning, the unit cell size may be less than a surface wave wavelength. Otherwise, grating lobes may invariably be located in the radiation pattern. In this exemplary embodiment, the second antenna 150 may have a higher operation frequency than the first antenna 110. For example, the operation frequency of the first antenna 110 may be 8 GHz and the operation frequency of the second antenna 150 may be 12 GHz.

The unit cell 192, 194 may be repeated periodically to create the antenna elements 130, 170 as shown in FIG. 2B. In order to properly excite radiated waves over a wide range of angles, the unit cell x-direction length may be less than $\lambda/4$, where $\lambda$ is the wavelength of a plane wave in free space at the operating frequency of the antenna. The smaller the unit cell length, the more precise pointing of the radiation angle. However, smaller unit cell lengths may need more tuning devices, and more challenging fabrication tolerances. Therefore, in the preferred exemplary embodiment, the unit cell length may be in the range of $\lambda/20$ to $\lambda/4$.

Along the y-direction perpendicular dimension to the antennas 110, 150, the interleave antenna element 190 can be arrayed to form a phased array antenna. This enables two-dimensional beam-steering. In this dimension, the element pitch d that can generate a beam in a direction $\theta$, the radiation angle with respect to broadside (the z-axis), without grating lobes is:

$$d<\lambda/(1+\sin\theta)$$

For a beam at end-fire ($\theta$=90 degrees), the element spacing d may be below $\lambda/2$ to prevent grating lobes. For a beam at broadside ($\theta$=0 degrees), the element spacing d may be below $\lambda$ to prevent grating lobes. For any element spacing d greater than $\lambda$, there may invariably be a grating lobe which degrades the performance and utility of the antenna. The element spacing d between the surface-wave waveguides 130 and 170 may be less than the wavelengths of the operating frequencies of the antennas 110 and 150. Since the element spacing d may be less than a wavelength, both the first and second surface-wave waveguides 130 and 170 may fit within this spacing. The sizes of the interleaved antenna elements of the antennas 110, 150 may be small enough to fit into the array spacing of the highest frequency (for example, approximately $\lambda/2$ at the highest frequency). The antenna elements of the antennas 110, 150 are located immediately adjacent to each other and each element shares the same conductive fence 260.

The antenna elements 130 or 170 are surface-wave waveguides and may be, for instance, but not limited to, arrays of tunable impedance elements with electrically-variable capacitors between them. The radiation may be scanned in elevation by electronically varying the impedance modulation. The antenna can scan in azimuth by tuning the relative phase between the surface-wave waveguide modulation patterns.

The first surface-wave waveguide 130 of the first antenna 110 may comprise a plurality of first impedance elements 210. The second surface-wave waveguide 170 of the second antenna 150 may comprise a plurality of second impedance elements 215. One impedance element of a plurality of impedance elements 210 and 215 may be implemented in a number of different ways. In one illustrative example, an impedance element may be implemented as a resonating element. In another illustrative example, an impedance element may be implemented as an element comprised of a conductive material. The conductive material may be, for example, without limitation, a metallic material. For instance, depending on the implementation, an impedance element may be implemented as a metal patch, a metallic strip, a patch of conductive paint, a metallic mesh material, a metallic film, a deposit of a metallic substrate, or some other type of conductive element.

In the exemplary embodiment illustrated in FIGS. 2A-2C, the impedance elements 210 and 215 may be conductive elements, for example, but not limited to, an array of parallel metal patches. In one illustrative example, the plurality of metallic patches 210 or 215 may be arranged in a row that extends along the x-axis as shown in FIG. 2B. The plurality of metal patches 210 or 215 may be periodically distributed on the dielectric substrate along the x-axis. For example, when the first operation frequency $f_1$ of the first antenna 110 is 8 GHz and the second operation frequency $f_2$ of the second antenna 150 is 12 GHz, the first antenna 110 may have thirty (30) conductive elements with 6 mm unit cell x-dimension length and the second antenna 150 may have sixty (60) conductive elements with 3 mm unit cell x-direction length.

The conductive elements 210 and 215 may have various shapes. For example, when the first operation frequency $f_1$ of the first antenna 110 is 8 GHz and the second operation frequency $f_2$ of the second antenna 150 is 12 GHz, the first conductive element 210 may be implemented as one or more diamond-shaped metal patches and the second conductive element 215 may be implemented as one or more square-shaped metal patches. Alternatively, the first conductive elements 210 may have square-shaped metal patches and the second conductive elements 210 may have diamond-shaped metal patches, or both the first conductive elements 210 and the second conductive elements 215 may have one of a square-shaped metal patch and a diamond-shaped metal patch. The diamond shape may lower the capacitance in the unit cell 192 and may provide more convenient implementation. Further, instead of the diamond shape, a larger gap between the conductive elements 210 or 215 may be used to reduce the capacitance. The x-dimension length of the unit cell 192 of the 8 GHz antenna 110 may be double the x-dimension length of the unit cell 194 of the 12 GHz antenna 150. One skilled in the art will understand that there are many other shapes and structures of the first and second conductive elements 210 and 215, for example, but not limited to, circle, oval or polygon shapes which might perform in the present disclosure with similar results, provided the teachings of the present disclosure are incorporated therein.

In FIG. 2A, the impedance elements 210 and 215 are illustrated each as a raised structure. However, the impedance elements 210 and 215 may have the same height as other metal components fabricated on the top layer 242 of the antenna system 200, such as control or bias lines 230 or 235.

As illustrated in FIG. 2B, one or more first tuning elements 220 may be connected between the first impedance or conductive elements 210, and one or more second tuning elements 225 may be connected between the second impedance or conductive elements 215. The tuning elements 220 and 225 may be electronically controllable or tunable by applying biases to adjacent elements 215 (or 210) using control or bias lines 235 (or 230). For example, each one of the tuning elements 220 and 225 may be controlled, or tuned, to change an angle of a surface wave being propagated along the surface-wave waveguide 130 or 170.

The tuning elements 220 and 225 may have a capacitance that can be varied based on the voltage applied to the tuning elements 220 and 225. The tuning element 220 or 225 may have a capacitance range, for example, but not limited to, from 0.15 to 1.1 pF. For example, the tuning elements 220 and 225 may be a capacitor, a varactor, or a diode, such as a PIN diode, or any appropriate element having a capacitance.

Voltages may be applied to the tuning elements 220 and 225 by applying voltages to the impedance elements 210 and 215 because the impedance elements 210 and 215 may be electrically connected to the tuning elements 220 and 225. In particular, the voltages applied to the impedance elements 210 and 215, and thereby the tuning elements 220 and 225 may change the capacitance of the tuning elements 220 and 225. Changing the capacitance of the tuning elements 220 and 225 may, in turn, change the surface impedance of the antennas 110 and 150. Changing the surface impedance of the antennas 110 and 150 may change a radiation pattern produced.

In other words, by controlling the voltages applied to the impedance elements 210 and 215, the capacitances of the tuning elements 220 and 225 may be varied. Varying the capacitances of the tuning elements 220 and 225 may vary, or modulate, the capacitive coupling and impedance between the impedance elements 210 and 215. Varying, or modulating, the capacitive coupling and impedance between the impedance elements 210 and 215 may change the steering angle.

As illustrated in FIG. 2B, the voltages applied to the first tuning elements 220 and the second tuning elements 225 may be supplied by first control or bias lines 230 and second control or bias lines 235, respectively. The first control or bias lines 230 may attach to each first conductive element 210 to provide a control signal, for example, but not limited to, direct current (DC) bias to the first tuning elements 220 in the form of a current or voltage. Likewise, the second control or bias lines 235 may attach to each second conductive element 215 to provide DC bias to the second tuning elements 225 in the form of a current or voltage. Each of the first control line 230 and the second control line 235 may be connected to the first conductive element 210 of the first antenna 110 and the second conductive element 215 of the second antenna 150 independently.

Figure 6:
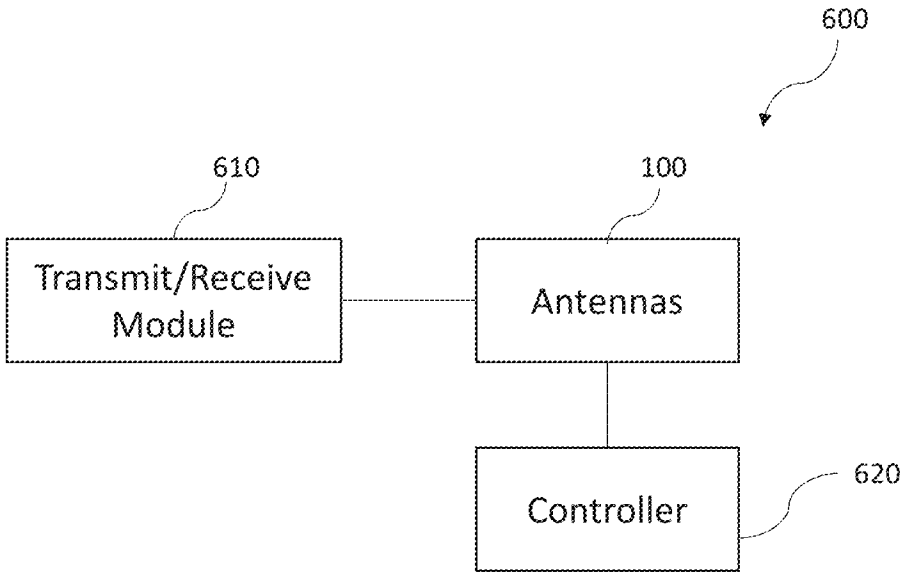
FIG. 6 is a diagram of an antenna system according to an embodiment of the present disclosure.

The first control or bias lines 230 and second control or bias lines 235 may be connected to a controller 620 such as shown in FIG. 6. The controller 620 may comprise one or more of voltage sources, grounds, voltage lines, and/or some other type of components. For example, the voltage sources may be coupled to the control or bias lines 230 and 235 to supply voltages to the impedance elements 210 and 215. The voltage source may take the form of, for example, without limitation, a digital to analog converter (DAC), a variable voltage source or some other type of voltage source. The grounds may be used to ground at least a portion of the impedance elements 210 and 215. The voltage lines may be used to transmit voltage from the voltage sources and/or the grounds to the impedance elements 210 and 215. In some cases the voltage lines may be referred to as a via. In one illustrative example, some voltage lines may take the form of metallic vias. In the exemplary embodiment, the voltage lines may be the control or bias lines 230 and 235. In one illustrative example, each of the impedance elements 210 and 215 may receive voltage from the voltage sources of the controller 620. In another illustrative example, a portion of the impedance elements 210 and 215 may receive voltage from the voltage sources of the controller 620 through a corresponding portion of the voltage lines, while another portion of the impedance elements 210 and 215 may be electrically connected to the grounds through a corresponding portion of the control or bias lines 230 and 235. The controller 620 may be used to control the voltage sources. The controller 620 may be considered part of or separate from an antenna system 200 or 600, depending on the implementation. The controller 620 may be implemented using a microprocessor, an integrated circuit, a computer, a central processing unit, a plurality of computers in communication with each other, or some other type of computer or processor.

The control or bias lines 230 and 235 may be positioned orthogonally to the electric field in the antennas 110 and 150 in order to minimally interact with each mode. However, the antennas 110 and 150 may be tuned with tuning devices in place in order to properly account for additional capacitance. For example, as illustrated in FIG. 2B, the first control line 230 may be formed in a y-direction which is perpendicular to an elongated array of the first impedance elements 210, and the second control line 235 may be formed in a y-direction which is perpendicular to an elongated array of the second conductive elements 215.

Figure 4:
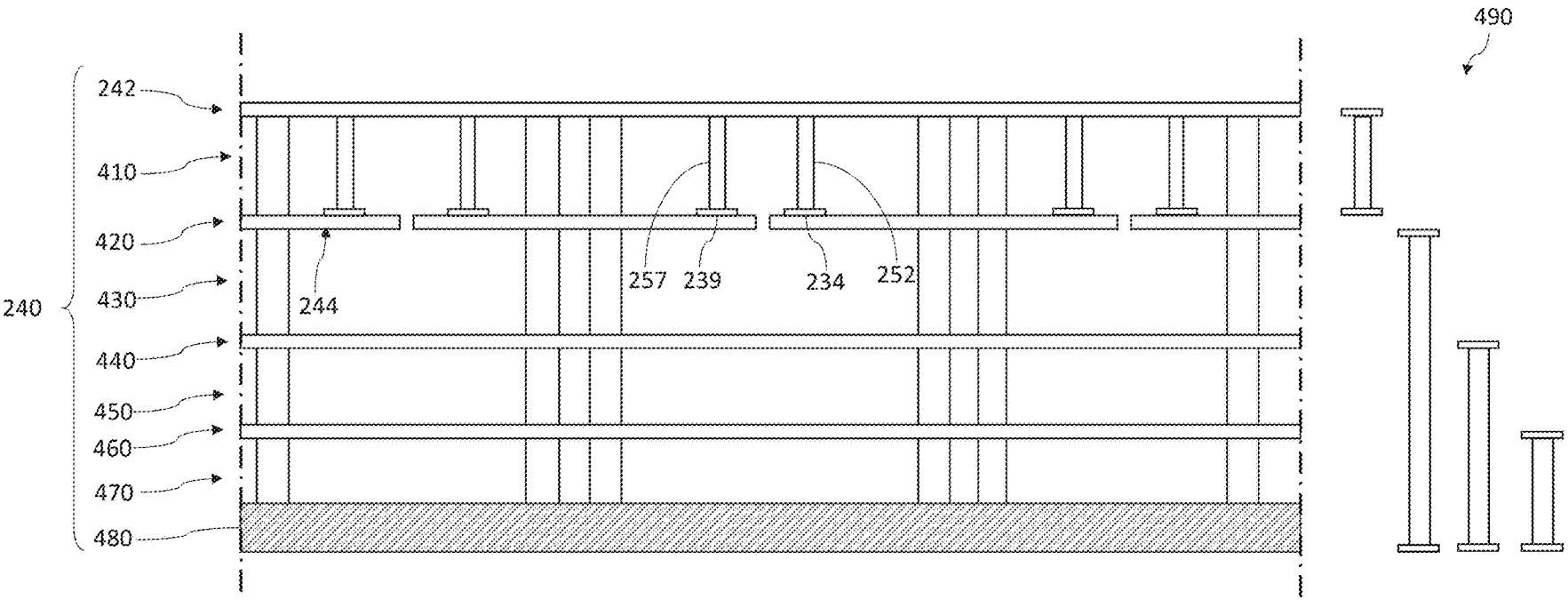
FIG. 4 shows a cross-sectional view of a multilayer structure of an antenna system according to an exemplary embodiment of the present disclosure.

The first control lines 230 of the first antenna 110 and the second control lines 235 of the second antenna 150 may not couple each other. To prevent coupling between the first control lines 230 and the second control lines 235, a multilayer structure, such as a multilayered printed circuit board, including at least one dielectric layer and at least two metal layers and vias can be used. In the exemplary embodiment of the present disclosure shown in FIG. 2A, the antenna system 200 may have a multilayer structure 240 including a plurality of metal layers, such as a top layer 242, an upper inner layer 244, a lower inner layer 246 and a bottom layer 248. The multilayer structure 240 may further comprise dielectric layers between the top layer 242, the upper inner layer 244, the lower inner layer 246 and the bottom layer 248. The impedance elements 210 and 215, the tuning elements 220 and 225, first upper control lines 232 coupled to the first impedance elements 210, and second upper control lines 237 coupled to the second impedance elements 215 may be formed at or on the top layer 242. First lower control lines 234, connected to the first upper control lines 232 by first vias 252, and second lower control lines 239, connected to the second upper control lines 237 by second vias 257, may be formed at or on the upper inner layer 244. Although FIG. 2A illustrates that the first lower control lines 234 are disposed higher than the second lower control lines 239, the first lower control lines 234 and the second lower control lines 239 may be disposed at the same level as shown in FIG. 4. The lower inner layer 246 may be a ground layer for the second antenna 170. The bottom layer 248 may be a ground layer for the first antenna 110. For example, the bottom layer 248 may be solid metal.

Figure 5:
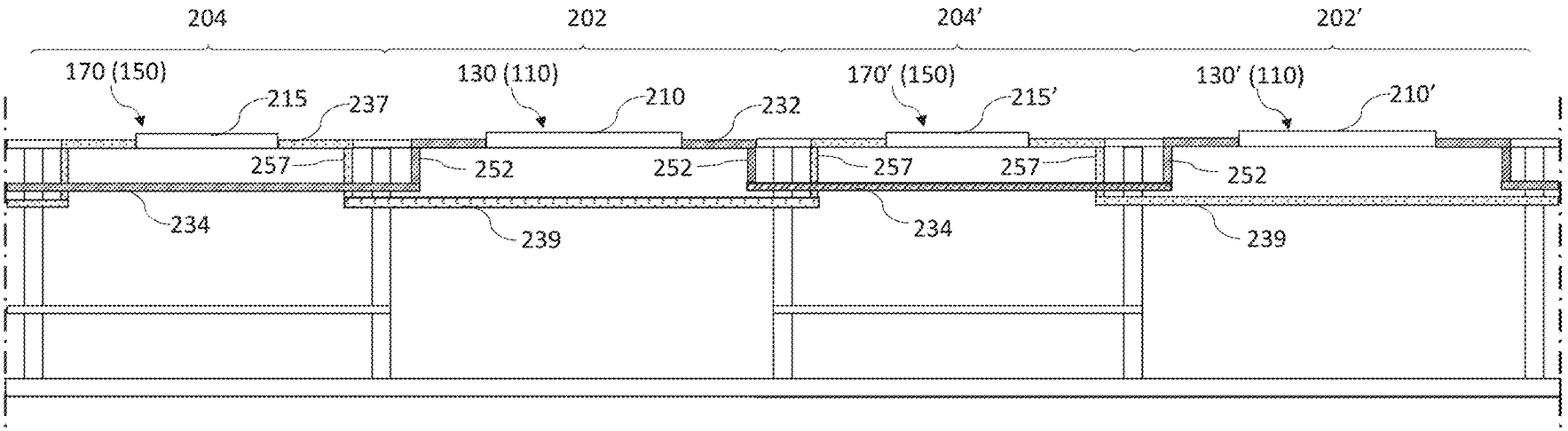
FIG. 5 is a cross-sectional view of two interleaved antenna elements of an antenna system according to an embodiment of the present disclosure.

The conductive metal trace for providing DC bias to the first antenna 110 may not contact the second antenna 150. Instead, the conductive metal trace for the first antenna 110 may pass underneath the second antenna 150. For example, the conductive metal trace for the first antenna 110 may comprise the first upper control line 232 formed in or on the top layer 242 of the antenna system 200, the first via 252 formed in the dielectric layer (e.g. a first dielectric layer 410 shown in FIG. 4) located between the top layer 242 and the upper inner layer 244, and the first lower control line 234 formed in or on the upper inner layer 244. The first impedance element 210 of the first antenna 110 located in the section 202 may be connected to an adjacent first impedance element 210' located in the section 202' by the conductive metal traces of the first control line 230 formed by the first upper control lines 232, the first vias 252 and the first lower control lines 234 as shown in FIG. 5. Specifically, the first upper control line 232 of the top layer 242 extends away from the first impedance element 210 and is connected to the first via 252 coupled to the first lower control line 234. In other words, before reaching the section 204' for the second antenna 150, the conductive metal trace of the first control line 230 of the first antenna 110 may be dropped to the upper inner layer 244 through the first via 252 and pass out to the next section 202' for the first antenna 110 of the next cell as shown in FIG. 5. The first lower control line 234 of the first antenna 110 passes under the second surface-wave waveguide 170 of the second antenna 150 along the upper inner layer 244 and is connected to the first via 252 and the first upper control line 232 of an adjacent first surface-wave waveguide 130' as shown in FIG. 5.

Likewise, the conductive metal trace for providing DC bias to the second antenna 150 may not contact the first antenna 110. Instead, the conductive metal trace for the second antenna 150 may pass underneath the first antenna 110. For example, the conductive metal trace for the second antenna 150 may comprise the second upper control line 237 formed in or on the top layer 242 of the antenna system 200, the second via 257 formed in or on the dielectric layer (e.g. a first dielectric layer 410 shown in FIG. 4) located between the top layer 242 and the upper inner layer 244, and the second lower control line 239 formed in the upper inner layer 244. The second impedance element 215 of the second antenna 150 located in the section 204 may be connected to an adjacent second impedance element 215' located in the section 204' by the conductive metal traces of the second control line 235 formed by the second upper control lines 237, the second vias 257 and the second lower control lines 239 as shown in FIG. 5. Specifically, the second upper control line 237 of the top layer 242 extends away from the second impedance element 215 and is connected to the second via 257 coupled to the second lower control line 239. In other words, before reaching the section 202' for the first antenna 110, the conductive metal trace of the second control line 235 of the second antenna 150 may be dropped to the upper inner layer 244 through the second via 257 and pass out to the next section 204' for the second antenna 150 of the next cell as shown in FIG. 5. The second lower control line 239 of the second antenna 150 passes under the first surface-wave waveguide 130 of the first antenna 110 along the upper inner layer 244 and is connected to the second via 257 and the second upper control line 237 of an adjacent second surface-wave waveguide 170' as shown in FIG. 5.

Therefore, in the exemplary embodiment of the present disclosure, by using the multilayer structure 240, such as the multi-layered PCB, each of the first control lines 230 and the second, control lines 235 may be connected to the first antenna 110 and the second antenna 150 independently and coupling between the first antenna 110 and the second antenna 150 may be prevented.

At least one portion of the first impedance elements 210 may be electrically connected to the bottom ground layer 248, which is a ground layer for the first antenna 110, with vias that run from each first impedance element 210 down through the dielectric substrate. At least one portion of the second impedance elements 215 may be electrically connected to the lower inner layer 246, which is a ground layer for the second antenna 150, with vias that run from each second impedance element 215 down through the dielectric substrate.

The antenna system 200 may further comprise conductive fences 260, also known as a "via fence" or "picket fence". The conductive fence 260 may be disposed between the first section 202 for the first antenna 110 and the second section 204 for the second antenna 150, for example, but not limited to, between the first surface-wave waveguide 130 of the first antenna 110 and the second surface-wave waveguide 170 of the second antenna 150. A conductive wall separating each antenna may be created by the conductive fence 260. The conductive fence 260 may prevent coupling between the first antenna 110 and the second antenna 150.

In one exemplary embodiment, the conductive fence 260 may include a grid of metal. The conductive fence 260 may be constructed in the multilayer PCB. For example, the conductive fence 260 may comprise vertical metal elements 262 and/or horizontal metal elements 264. For example, the vertical metal elements 262 may be provided by vias 263 which are drilled holes from the top layer to the bottom layer of the antenna system 200 and then plated with metal. The vias 263 of the vertical metal elements 262 may be formed from the top layer 242 to the bottom layer 248 of the antenna system 200. The horizontal metal elements 264 may be implemented as metal patterns fabricated or etched in a horizontal plane as metal layers included in the multilayer PCB structure. The horizontal metal elements 264 may be formed to connect between the vias 263 of the vertical metal element 262. The horizontal metal element 264 may be arranged to be parallel to the first surface-wave waveguide 130 of the first antenna 110 and/or the second surface-wave waveguide 170 of the second antenna 150.

The conductive fence 260 may further comprise via pads 265. The via pads 265 may be disposed on the top layer 242 of the antenna system 200. The via pads 265 may also be formed at the metal layers between the dielectric layers, for example, metal layers 420, 440 and 460 of FIG. 4, and may be positioned between the horizontal metal elements 264. The via pads 265 may be, for example, but not limited to, circular metal, and may be fabricated as a single unified metal pattern. The diameters of the via pads 265 may be slightly larger than those of the vias 263.

Figure 3A:
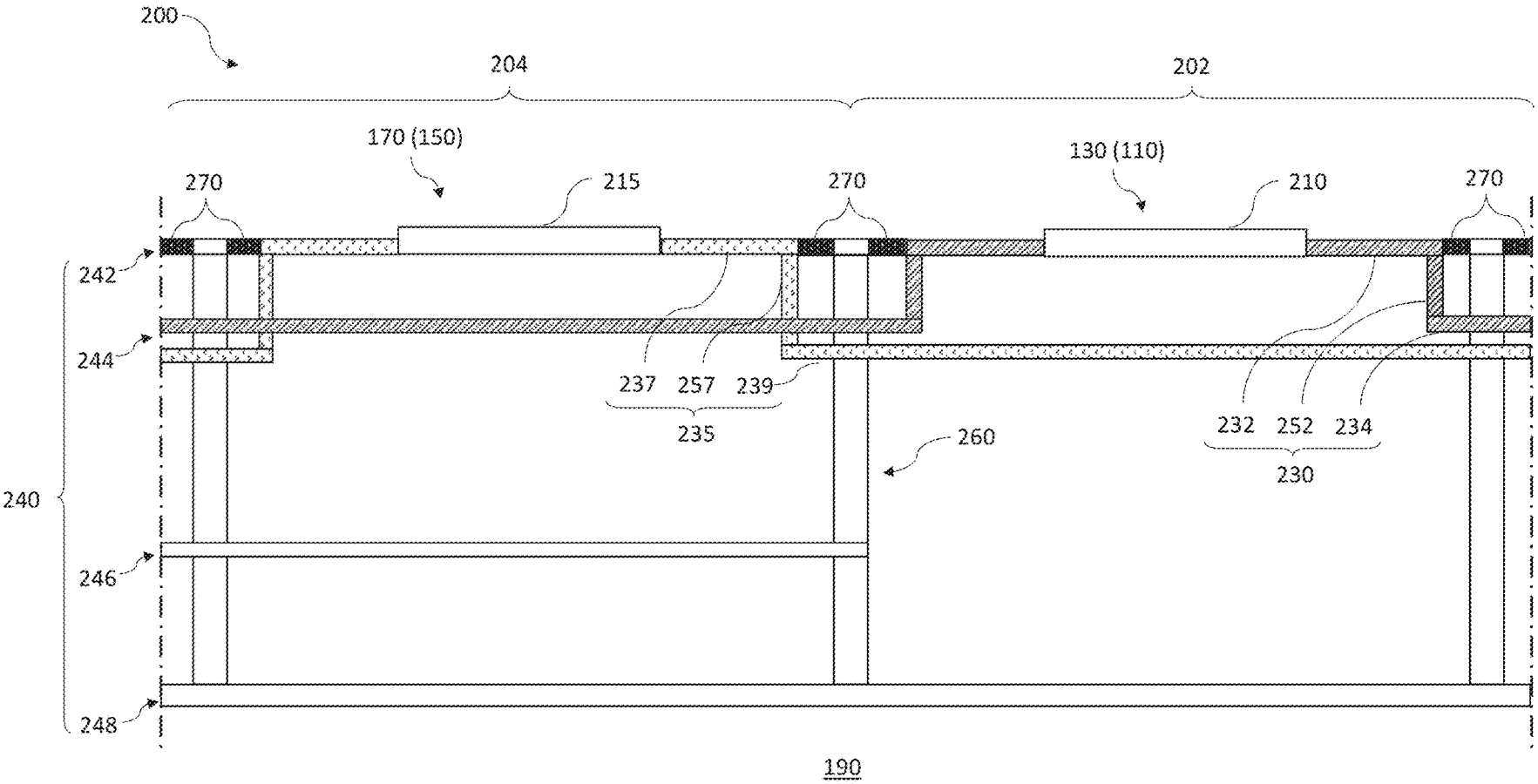
FIG. 3A is a cross-sectional view of an interleaved antenna element of an antenna system according to a second embodiment of the present disclosure.
Figure 3B:
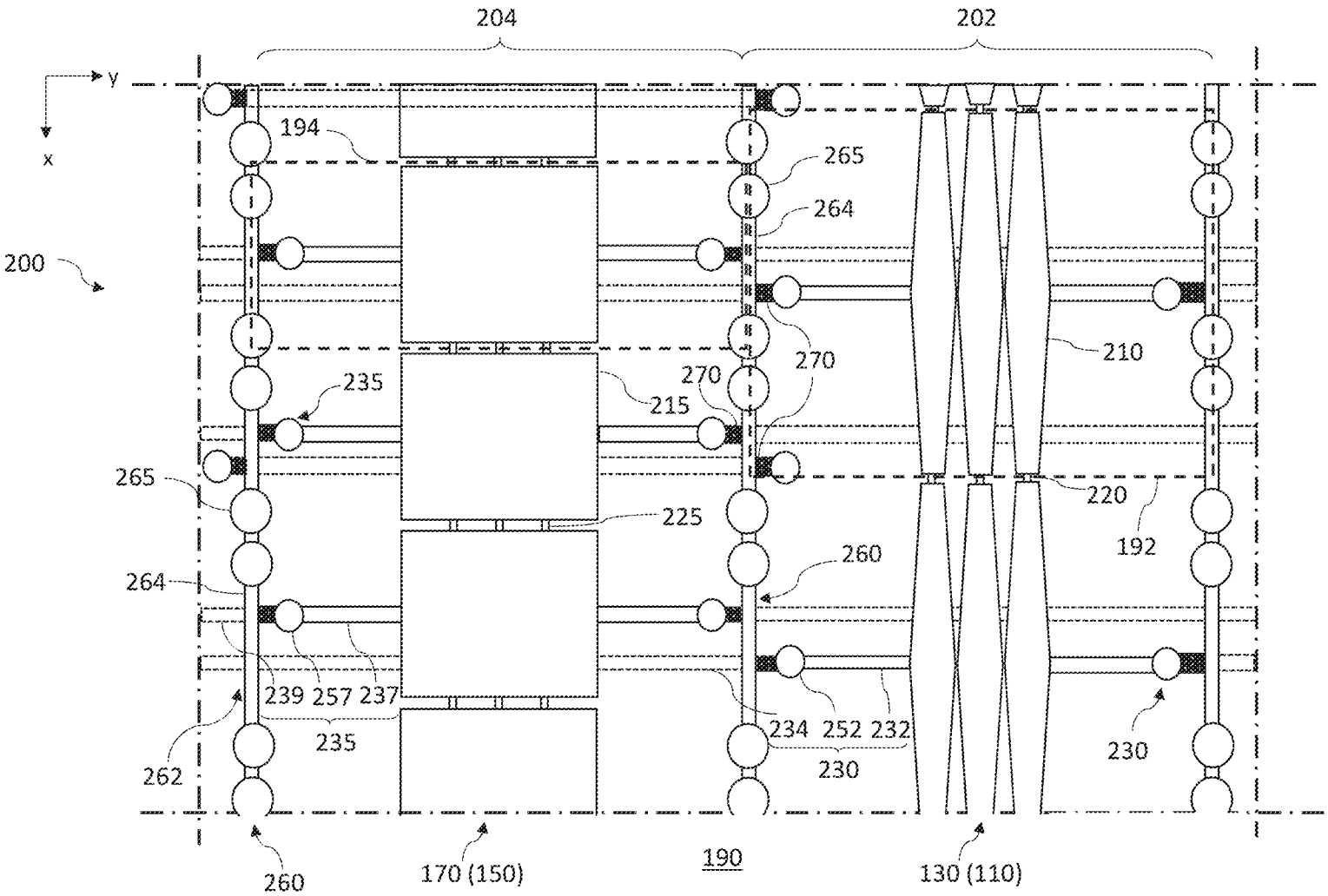
FIG. 3B is a top view of an interleaved antenna element of an antenna system according to a second embodiment of the present disclosure.
Figure 3C:
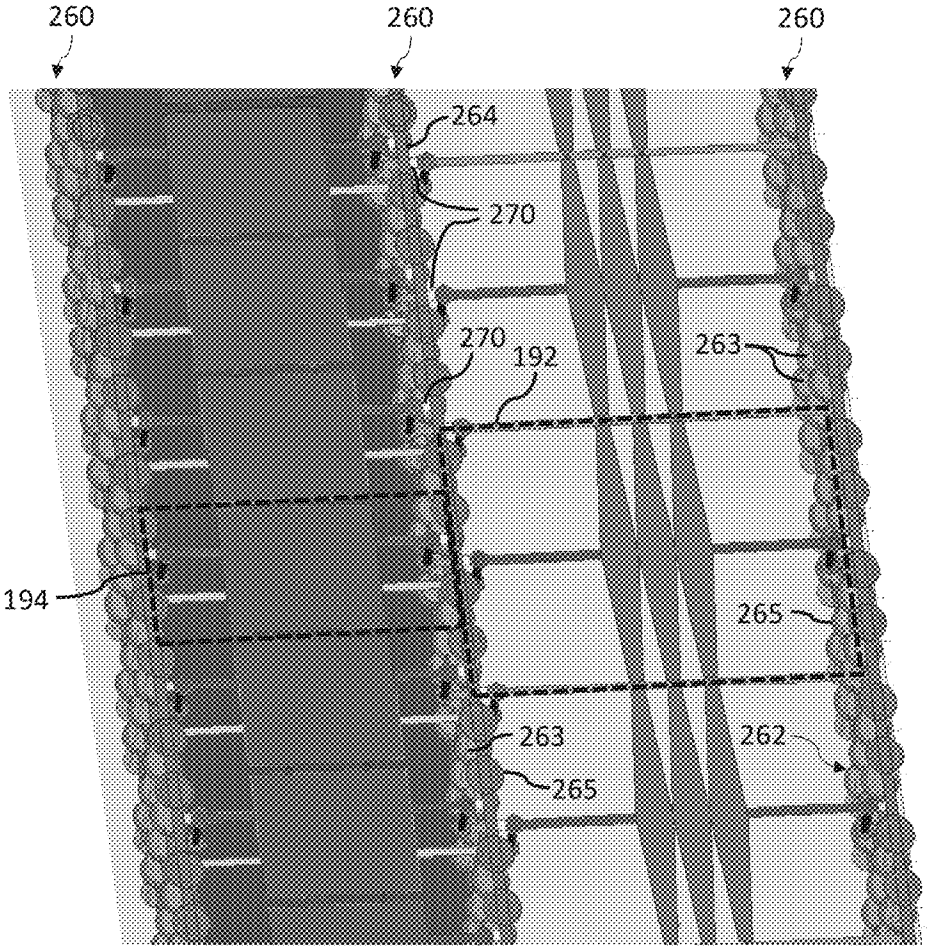
FIGS. 3C and 3D are angular perspective views of an interleaved antenna element of an antenna system according to a second embodiment of the present disclosure.
Figure 3D:
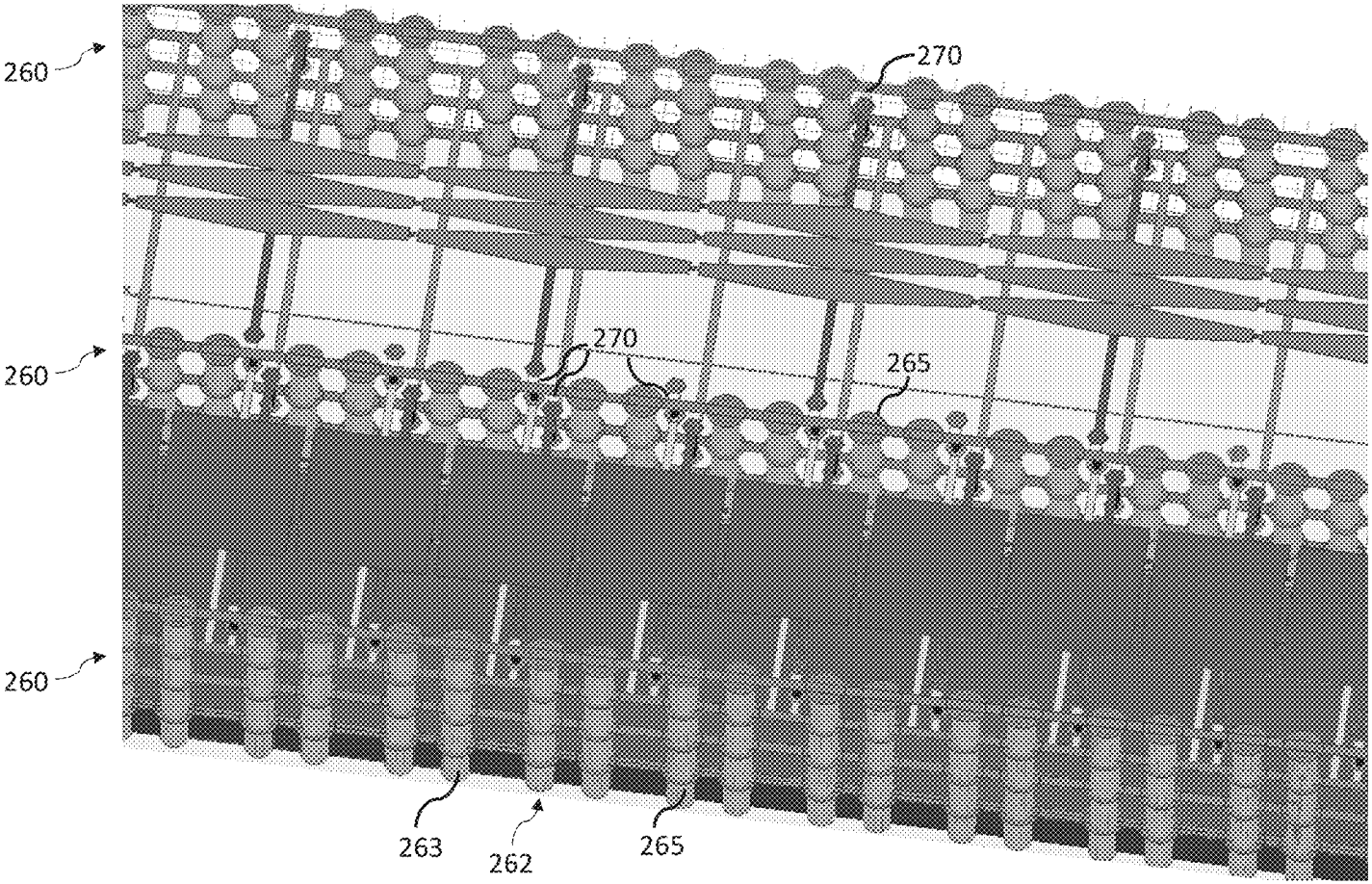

The antenna system 200 may further comprise capacitors 270. While FIGS. 2A-2C illustrate the exemplary embodiments of the antennas system without capacitors for RF short to the conductive fence 260, FIGS. 3A-3D illustrate some embodiments of the antennas system including capacitors for an RE short to the conductive fence 260. FIG. 3A is a cross-sectional view of a unit cell of an array of antennas including capacitors for an RF short to conductive fences according to an embodiment of the present disclosure, FIG. 3B is a top view of a unit cell of arrays of antennas including capacitors for an RF short to conductive fences according to an embodiment of the present disclosure, and FIGS. 3C and 3D are angular perspective views of a unit cell of arrays of antennas including capacitors for an RF short to conductive fences according to an embodiment of the present disclosure, using the same components and numerals in FIGS. 2A-2C. Here, the same descriptions as those in the embodiment of FIGS. 2A-2C will be omitted.

The capacitors 270 may be disposed on the top layer 242 of the antenna system 200 or at any other metal layer if appropriate. The capacitors 270 may be provided between the control or bias lines 230 and 235 and the conductive fence 260. In the exemplary embodiments shown in FIGS. 3A-3D, the capacitor 270 is disposed between the end of the second upper control line 237 and the horizontal metal element 264 of the conductive fence 260. The capacitor 270 may be disposed between the first via 252 and the conductive fence 260. And, the capacitor 270 may be disposed between the second via 257 and the conductive fence 260. The capacitor 270 may create an RF short to the conductive fence 260 and a DC open. The RF short may prevent RF power from coupling through the conductive fence 260. The DC open may be needed so that different voltages can be provided to each of the control or bias lines 230 and 235.

FIG. 4 shows a cross-sectional view of a multilayer structure of an antenna system according to an exemplary embodiment of the present disclosure. The antenna system 200 or 600 may comprise, for example, but not limited to, four (4) dielectric layers and three (3) prepreg layers. For instance, the thickness of the dielectric layer may be 32 mils and the thickness of the prepreg layer may be 4 mils. The dielectric constant of the dielectric layer may be 6.15 and the dielectric constant of the prepreg layer may be 3.55.

The impedance elements 210 and 215, the tuning elements 220 and 225, some portions of the first and second control lines 230 and 235 (e.g., the first upper control lines 232 and second upper control lines 237) may be disposed on top layer 242 which is the top surface of a first dielectric layer 410.

The first vias 252 for the first antenna 110 and the second vias 257 of the second antenna 150 may be formed in the first dielectric layer 410.

The first prepreg layer 420 may comprise tuning traces, such as some portions of the first and second control lines 230 and 235 (e.g., the first lower control lines 234 and the second lower control lines 239). The first lower control lines 234 for the first antenna 110 coupled to the first vias 252 and the second lower control lines 239 for the second antenna 150 coupled to the second vias 257 may be disposed on the bottom surface of the first dielectric layer 410. The first lower control lines 234 and the second lower control lines 239 may be formed on the second metal layer 420.

The second prepreg layer 440 may be used as a layer for a feed network for feeding antennas. The third prepreg layer 460 may comprise the ground for the second antenna 150. The ground for the second antenna 150 may be disposed on the metal layer below the third dielectric layer 450.

The bottom layer 480 may comprise the ground layer 248 for the first antenna 110. The ground layer for the first antenna 110 may be disposed on the bottom surface of the fourth dielectric layer 470. For example, the bottom layer 480 may be implemented as solid metal.

The antenna system 200 may comprise blind vias 490. The blind vias 490 may be connected between two layers among the metal layers 242, 420, 440, 460 and 480 included in the multilayer structure 240 of the antenna system 200. The blind vias 490 may rout the DC bias traces.

Figure 7:
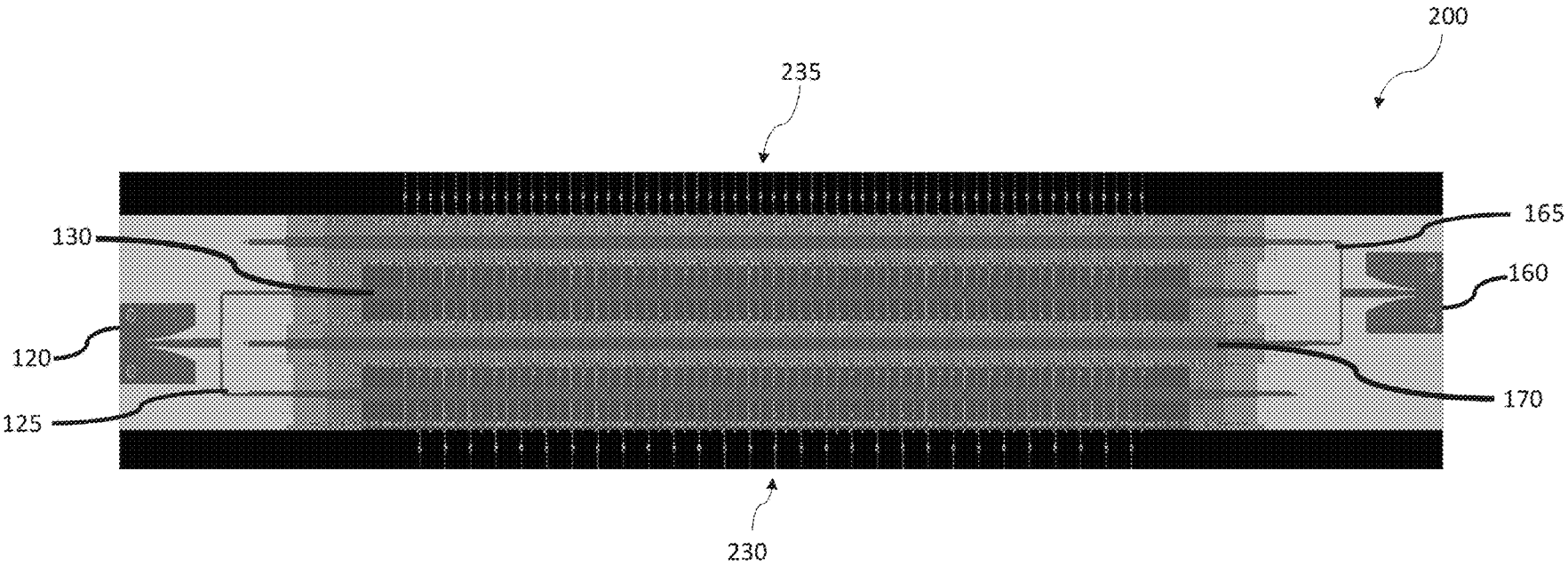
FIG. 7 shows a layout of the antenna system according to an exemplary embodiment of the present disclosure.
Figure 8:
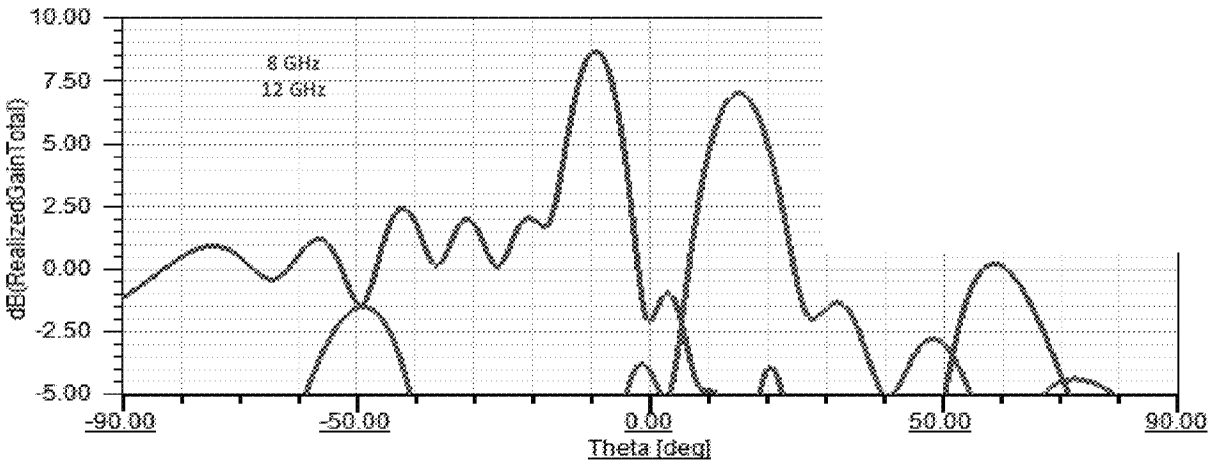
FIG. 8 shows simulation results of arrays of antennas having 8 GHz and 12 GHz antennas according to an exemplary embodiment of the present disclosure.

FIG. 7 shows a layout of an antenna system according to an exemplary embodiment of the present disclosure. End-launch coplanar waveguide feeds may be located on either end of the antenna system 200, one for each antenna. For example, the first surface-wave feed 120 of the first antenna 110 may be positioned on the left end of the antenna system 200 while the second surface-wave feed 160 of the second antenna 150 may be positioned on the right end of the antenna system 200. A splitter (e.g., the first feed network 125 and the second feed network 165) feeds each antenna (e.g., the first antenna 110 and the second antenna 150) independently. The first control lines 230 for the first antenna 110 may be connected to the bottom side of the antenna system 200, and the second control lines 235 for the second antenna 150 may be disposed on the top side of the antenna system 200. FIG. 8 shows simulation results of arrays of antennas having 8 GHz and 12 GHz antennas according to an exemplary embodiment of the present disclosure.

According to various embodiments of the present disclosure, the plurality of antennas can operate at different frequencies simultaneously and/or perform independent beam scanning at different frequencies. The capability for simultaneous operation at different frequencies may provide significant benefits to commercial and government systems. For example, the antenna system according to some embodiments of the present disclosure may be operated on different satellite communication networks from the same aperture. Certain embodiments of the present disclosure may be used in numerous commercial aircraft to establish Ku and Ka band satellite communication networks. Some embodiments of the present disclosure may be used in mobile network, such as the fifth generation networks (5G) covering multiple frequency bands including 28, 38 and 60 GHz.

Some embodiments of the present disclosure may install the plurality of arrays of antennas operable at different frequencies in a single aperture, and therefore may reduce the size of an antenna array package. For example, a multi-frequency aperture for satellite communications on an aerial or ground platform may allow multi-functional capability from the same physical space. This may be important in applications having limited space, for example, on small aircraft and vehicles that have no additional room for the plurality of apertures. Antenna size reduction may also improve aircraft or vehicle fuel efficiency due to reduced atmospheric drag from the protective radome. Further, a single aperture that can operate over multiple frequencies may allow worldwide coverage.

Although the example embodiments have been described in detail, it should be understood that various changes, substitutions and alterations can be made herein without departing from the spirit and scope of the application as defined by the appended claims.

Moreover, the scope of the present application is not intended to be limited to the particular embodiments of the process, machine, manufacture, and composition of matter, means, methods and steps described in the specification. As one of ordinary skill in the art will readily appreciate from the disclosure, processes, machines, manufacture, compositions of matter, means, methods or steps, presently existing or later to be developed, that perform substantially the same function or achieve substantially the same result as the corresponding embodiments described herein may be utilized according to the embodiments and alternative embodiments. Accordingly, the appended claims are intended to include within their scope such processes, machines, manufacture, compositions of matter, means, methods, or steps.

What is claimed is:

1. An antenna system, comprising:

a plurality of electronically steerable antennas configured to be operable at different frequencies, each of the antennas comprising a feed launching a surface wave and surface-wave waveguides connected to the feed, wherein the surface-wave waveguides of the antennas operable at different frequencies are interleaved with each other, wherein the plurality of electronically steerable antennas comprise:

a first antenna configured to be operable at a first frequency, the first antenna comprising first waveguides; and a second antenna configured to be operable at a second frequency different from the first frequency, the second antenna comprising second waveguides, wherein the first waveguides of the first antenna and the second waveguides of the second antenna are interleaved with each other, and wherein the antenna system further comprises:

a conductive fence between one of the first waveguides and one of the second waveguides; and a capacitor positioned between the conductive fence and one of the first or second control lines.

2. The antenna system of claim 1, wherein the first antenna and the second antenna are configured to be simultaneously operable at the first frequency and the second frequency, respectively.

3. The antenna system of claim 1, wherein the first and second antennas are installed in a single aperture.

4. The antenna system of claim 1, wherein:

the first waveguides comprise first impedance elements and first tuning elements, at least one of the first tuning elements connected between the first impedance elements;

the second waveguides comprise second impedance elements and second tuning elements, at least one of the second tuning elements connected between the second impedance elements; and the antenna system further comprises first control lines coupled to the first waveguides to supply a first voltage or current to the first tuning elements, and second control lines coupled to the second waveguides to supply a second voltage or current to the second tuning elements.

5. The antenna system of claim 4, wherein the first waveguides and the second waveguides are parallel to each other, and the first waveguides and the second waveguides are perpendicular to the first control lines and the second control lines.

6. The antenna system of claim 4, wherein the first control lines for the first antenna and the second control lines for the second antenna are arranged not to contact each other.

7. The antenna system of claim 4, wherein the first control lines for the first antenna are disposed not to contact the second waveguides for the second antenna and the second control lines for the second antenna are disposed not to contact the first waveguides for the first antenna.

8. The antenna system of claim 1, further comprising a conductive fence between one of the first waveguides and one of the second waveguides.

9. The antenna system of claim 8, wherein the conductive fence comprises a metal grid.

10. The antenna system of claim 8, wherein the conductive fence comprises vias formed in a vertical direction and horizontal conductive lines formed on at least one metal layer.

11. The antenna system of claim 10, further comprising via pads formed on the vias, the via pads having a larger diameter than the vias.

12. The antenna system of claim 1, further comprising:

a first ground layer for the first waveguides; and a second ground layer for the second waveguides.

13. The antenna system of claim 4, wherein the first and second tuning elements comprise at least one of a capacitor, a varactor or a diode.

14. The antenna system of claim 4, wherein the first and second impedance elements comprise a conductive patch.

15. The antenna system of claim 1, wherein the first waveguides of the first antenna and the second waveguides of the second antenna are disposed to alternate with each other.

16. The antenna system of claim 1, wherein a spacing between the surface-wave waveguides of the antennas is less than wavelengths of the operable frequencies of the antennas.

17. An antenna system, comprising:

a plurality of electronically steerable antennas configured to be operable at different frequencies, each of the antennas comprising a feed launching a surface wave and surface-wave waveguides connected to the feed, wherein:

the surface-wave waveguides of the antennas operable at different frequencies are interleaved with each other;

the plurality of electronically steerable antennas comprise: a first antenna configured to be operable at a first frequency, the first antenna comprising first waveguides, and a second antenna configured to be operable at a second frequency different from the first frequency, the second antenna comprising second waveguides;

the first waveguides of the first antenna and the second waveguides of the second antenna are interleaved with each other;

the first waveguides comprise first impedance elements and first tuning elements, at least one of the first tuning elements connected between the first impedance elements;

the second waveguides comprise second impedance elements and second tuning elements, at least one of the second tuning elements connected between the second impedance elements;

the antenna system further comprises first control lines coupled to the first waveguides to supply a first voltage or current to the first tuning elements, and second control lines coupled to the second waveguides to supply a second voltage or current to the second tuning elements; and the first control lines for the first antenna pass underneath the second waveguides for the second antenna and the second control lines for the second antenna pass underneath the first waveguides for the first antenna.

18. An antenna system, comprising:

a plurality of electronically steerable antennas configured to be operable at different frequencies, each of the antennas comprising a feed launching a surface wave and surface-wave waveguides connected to the feed, wherein:

the surface-wave waveguides of the antennas operable at different frequencies are interleaved with each other;

the plurality of electronically steerable antennas comprise: a first antenna configured to be operable at a first frequency, the first antenna comprising first waveguides, and a second antenna configured to be operable at a second frequency different from the first frequency, the second antenna comprising second waveguides;

the first waveguides of the first antenna and the second waveguides of the second antenna are interleaved with each other;

the first waveguides comprise first impedance elements and first tuning elements, at least one of the first tuning elements connected between the first impedance elements;

the second waveguides comprise second impedance elements and second tuning elements, at least one of the second tuning elements connected between the second impedance elements;

the antenna system further comprises first control lines coupled to the first waveguides to supply a first voltage or current to the first tuning elements, and second control lines coupled to the second waveguides to supply a second voltage or current to the second tuning elements; and a dielectric layer having a first surface and a second surface, wherein the first and second waveguides are disposed on the first surface of the dielectric layer; and some portions of the first and second control lines are disposed on the first surface of the dielectric layer and other portions of the first and second control lines are disposed on the second surface of the dielectric layer so that the first control lines do not contact the second waveguides and the second control lines do not contact the first waveguides.

19. The antenna system of claim 18, further comprising vias formed in the dielectric layer, the vias connecting between the some portions of the first and second control lines disposed on the first surface and the other portions of the first and second control lines are disposed on the second surface.

20. The antenna system of claim 18, further comprising:

a conductive fence between one of the first waveguides and one of the second waveguide; and a capacitor positioned between the conductive fence and one of the first or second control lines, wherein the capacitor is disposed on the first surface of the dielectric layer.

21. The antenna system of claim 19, further comprising:

a conductive fence between one of the first waveguides and one of the second waveguides; and a capacitor formed on the first surface of the dielectric layer between the conductive fence and one of the vias.

* * * * *